US011071660B1

(12) United States Patent
Yeom

(10) Patent No.: US 11,071,660 B1
(45) Date of Patent: Jul. 27, 2021

(54) EMERGENCY MEDICAL MAT FOR SAFE MOVEMENT IN CASE OF DISASTER

(71) Applicant: Seok Ran Yeom, Busan (KR)

(72) Inventor: Seok Ran Yeom, Busan (KR)

( * ) Notice: Subject to any disclaimer, the term of this patent is extended or adjusted under 35 U.S.C. 154(b) by 0 days.

(21) Appl. No.: 17/204,105

(22) Filed: Mar. 17, 2021

(30) Foreign Application Priority Data

Nov. 26, 2020 (KR) ..... 10-2020-0161147

(51) Int. Cl.

| | |
|---|---|
| ***A61G 1/01*** | (2006.01) |
| ***A61G 1/048*** | (2006.01) |
| ***A61G 1/044*** | (2006.01) |
| ***A61G 1/04*** | (2006.01) |

(52) U.S. Cl.
CPC ..... *A61G 1/01* (2013.01); *A61G 1/044* (2013.01); *A61G 1/048* (2013.01); *A61G 1/04* (2013.01)

(58) Field of Classification Search
CPC ... A61G 1/00; A61G 1/01; A61G 1/04; A61G 1/044; A61G 1/048
USPC ..... 5/621, 625, 628, 81.1 R, 81.1 HS, 703, 5/690
See application file for complete search history.

(56) References Cited

U.S. PATENT DOCUMENTS 2,279,694 A * 4/1942 Martinson ..... A61G 1/01 5/627
2,410,181 A * 10/1946 Peters ..... A61G 1/00 5/628
2,489,828 A * 11/1949 Springer ..... A61G 1/01 5/628
2,715,229 A * 8/1955 Hirschman ..... A47C 31/08 5/703
2,788,530 A * 4/1957 Ferguson ..... A61G 1/01 5/628
2,899,692 A * 8/1959 Finken ..... A61G 1/01 5/628
3,775,782 A * 12/1973 Rice ..... A61G 1/00 5/625
RE28,916 E * 7/1976 Rice ..... A61G 1/00 5/628
4,124,908 A * 11/1978 Burns ..... A61F 5/3776 2/69.5
KR 20-0322778 8/2003
WO 2004019852 3/2004

FOREIGN PATENT DOCUMENTS

JP 2015-202296 A 11/2015
KR 2019-990040788 U 12/1999
(Continued)

*Primary Examiner* — Robert G Santos
(74) *Attorney, Agent, or Firm* — Novick, Kirn & Lee, PLLC; Jae Youn Kim

(57) ABSTRACT

Disclosed is an emergency medical mat for safe movement in case of disaster, which has an improved structure that a side reinforcement belt and a floor reinforcement belt are arranged to be overlapped and fixed by backstitch parts so that a bottom surface of the mat is supported by the floor reinforcement belt when persons hold handle parts and lift up the medical mat to carry the mat and the structure prevents deformation of a middle area of the mat to which a deflection load is applied by a patient's weight, thereby preventing a secondary accident of a patient with a serious case during a disaster evacuation. The emergency medical mat for safe movement in case of disaster includes floor reinforcement belts, safe evacuation belts, and a side reinforcement belt.

7 Claims, 5 Drawing Sheets

(56) References Cited

U.S. PATENT DOCUMENTS 4,186,453 A * 2/1980 Burns ..... A61G 7/0504 5/628
4,466,145 A * 8/1984 Jones ..... A61G 1/00 441/40
4,601,075 A * 7/1986 Smith ..... A61G 1/044 128/870
4,665,908 A * 5/1987 Calkin ..... A61F 5/05883 128/870
4,679,260 A * 7/1987 Frettem ..... A61G 1/01 5/627
4,736,474 A * 4/1988 Moran ..... A61G 1/007 5/627
4,922,562 A * 5/1990 Allred ..... A61G 1/013 128/870
4,970,739 A * 11/1990 Bradford ..... A61G 1/00 128/870
5,027,833 A * 7/1991 Calkin ..... A61F 5/05883 128/870
5,065,464 A * 11/1991 Blanchard ..... A61G 7/103 5/81.1 R
5,121,514 A * 6/1992 Rosane ..... A61G 1/01 128/870
5,699,568 A * 12/1997 Couldridge ..... A61G 1/01 5/110
5,729,850 A * 3/1998 Eskeli ..... A61G 1/01 5/621
5,839,137 A * 11/1998 Butler ..... A61G 1/01 5/627
6,477,728 B1 * 11/2002 Faz ..... A61G 1/013 128/870
6,964,073 B1 * 11/2005 Curry ..... A61G 1/00 128/870
7,210,176 B2 * 5/2007 Weedling ..... A61G 7/0504 5/81.1 R
7,243,382 B2 * 7/2007 Weedling ..... A61G 7/05769 5/703
7,340,785 B2 * 3/2008 Weedling ..... A61G 7/1028 5/706
7,360,543 B1 * 4/2008 Coleman ..... A61F 5/3769 128/869
7,415,738 B2 * 8/2008 Weedling ..... A61G 7/103 5/710
7,591,029 B2 * 9/2009 Weedling ..... A61G 7/103 5/655.3
7,610,640 B2 * 11/2009 Post ..... A61G 7/0504 294/140
7,725,963 B2 * 6/2010 Johnson ..... A61G 7/103 5/81.1 R
7,739,758 B2 * 6/2010 Weedling ..... A61G 7/103 5/81.1 R
7,900,299 B2 * 3/2011 Weedling ..... A61G 7/1051 5/81.1 R
7,962,983 B2 * 6/2011 Keesaer ..... A61G 1/048 5/627
8,099,809 B2 * 1/2012 Tanaka ..... A61G 7/0504 5/628
8,234,727 B2 * 8/2012 Schreiber ..... A61G 7/1026 5/81.1 HS
8,528,137 B2 * 9/2013 Johnson ..... A61G 1/01 5/628
8,776,295 B2 * 7/2014 Myers ..... A47C 31/00 5/737
9,115,450 B2 * 8/2015 Myers ..... A47C 31/00
9,149,402 B2 * 10/2015 Gil Gomez ..... A61G 7/1028
9,216,128 B2 * 12/2015 Richardson ..... A61G 17/06
9,538,856 B2 * 1/2017 Myers ..... A47C 31/00
9,610,204 B1 * 4/2017 Steinbock ..... A61G 1/01
9,668,908 B1 * 6/2017 Al-Azmi ..... A61G 1/044
9,913,767 B2 * 3/2018 Olivo ..... A61G 7/103
10,085,901 B1 * 10/2018 Steinbock ..... B65D 33/06
10,561,557 B2 * 2/2020 Emerson ..... A61G 1/044
10,624,806 B2 * 4/2020 Emerson ..... A61G 7/1026
10,871,005 B2 * 12/2020 Olivo ..... A61G 1/013
10,932,963 B2 * 3/2021 Kenalty ..... A61G 1/044
10,993,863 B2 * 5/2021 Emerson ..... A61G 7/1026
2002/0162171 A1 * 11/2002 Faz ..... A61G 1/013 5/627
2002/0166168 A1 * 11/2002 Weedling ..... A61G 7/103 5/81.1 R
2003/0106155 A1 * 6/2003 Arai ..... A61G 1/00 5/627
2005/0028273 A1 * 2/2005 Weedling ..... A61G 7/1051 5/81.1 R
2005/0034229 A1 * 2/2005 Weedling ..... A61G 7/103 5/81.1 R
2005/0034230 A1 * 2/2005 Weedling ..... A61G 7/1096 5/81.1 R
2005/0076437 A1 * 4/2005 Johnson ..... B60P 7/16 5/81.1 R
2005/0172406 A1 * 8/2005 Post ..... B32B 5/02 5/626
2005/0193496 A1 * 9/2005 Weedling ..... A61G 7/1021 5/713
2005/0246834 A1 * 11/2005 Weedling ..... A61G 7/05769 5/81.1 R
2005/0283905 A1 * 12/2005 Johnson ..... B66F 3/35 5/81.1 R
2006/0000016 A1 * 1/2006 Weedling ..... A61G 7/1028 5/81.1 HS
2006/0037136 A1 * 2/2006 Weedling ..... G09F 3/00 5/81.1 HS
2006/0213010 A1 * 9/2006 Davis ..... A62B 99/00 5/626
2006/0253976 A1 * 11/2006 Weedling ..... A61G 7/1051 5/81.1 R
2009/0038076 A1 * 2/2009 Giduck ..... A61G 1/044 5/627
2009/0094743 A1 * 4/2009 Tanaka ..... A47C 31/08 5/81.1 T
2010/0005593 A1 * 1/2010 Bowling ..... A61G 1/044 5/627
2010/0199434 A1 * 8/2010 Keesaer ..... A61G 1/01 5/628
2010/0299836 A1 * 12/2010 Tanaka ..... A47C 31/08 5/626
2011/0056017 A1 * 3/2011 Schreiber ..... A61G 7/1026 5/81.1 HS
2011/0271450 A1 * 11/2011 Johnson ..... A61G 1/01 5/626
2012/0159715 A1 * 6/2012 Jung ..... A47C 31/08 5/703
2012/0284923 A1 * 11/2012 Jensen ..... A61G 1/04 5/627
2012/0297547 A1 * 11/2012 Myers ..... D05B 11/005 5/737
2013/0042409 A1 * 2/2013 Gil Gomez ..... A61G 7/1028 5/487
2013/0042414 A1 * 2/2013 Schreiber ..... A61G 7/05769 5/714
2014/0196647 A1 * 7/2014 Myers ..... A47C 31/00 112/475.08
2014/0259577 A1 * 9/2014 Richardson ..... A61G 17/06 27/28
2015/0313373 A1 * 11/2015 Myers ..... A47C 31/00 5/703
2017/0000667 A1 * 1/2017 Olivo ..... A61G 1/013
2017/0056268 A1 3/2017 Bullock
2018/0177649 A1 * 6/2018 Kenalty ..... A61G 1/01
2018/0195308 A1 * 7/2018 Olivo ..... A61G 1/003
2019/0091085 A1 * 3/2019 Emerson ..... A61G 1/044
2019/0091086 A1 * 3/2019 Emerson ..... A61G 7/1021
2020/0129355 A1 * 4/2020 Emerson ..... A61G 7/1026

* cited by examiner

EMERGENCY MEDICAL MAT FOR SAFE MOVEMENT IN CASE OF DISASTER

CROSS-REFERENCES TO RELATED APPLICATION

This application claims priority to and the benefit of Korean Patent Application No. 10-2020-0161147, filed on Nov. 26, 2020, the disclosure of which is incorporated herein by reference in its entirety.

BACKGROUND OF THE INVENTION

Field of the Invention

The present invention relates to an emergency medical mat for safe movement in case of disaster, and more particularly, to an emergency medical mat for safe movement in case of disaster, which has an improved structure that a side reinforcement belt and a floor reinforcement belt are arranged to be overlapped and fixed by backstitch parts so that a bottom surface of the mat is supported by the floor reinforcement belt when persons hold handle parts and lift up the medical mat to carry the mat and the structure prevents deformation of a middle area of the mat to which a deflection load is applied by a patient's weight, thereby preventing a secondary accident of a patient with a serious case during a disaster evacuation.

Background Art

In general, in case that a disaster such as fire or earthquake occurs in hospitals, medical facilities, or nursing facilities, it is necessary to carry a patient, who is hard to walk, a patient who lies in bed with illness, or a patient who is hard to evacuate for himself or herself, on a stretcher. However, it takes much time to evacuate since persons have to repeat the routine of returning after transporting a patient and transporting the next patient. Moreover, such an evacuation method must be carried out very carefully for critical patients who injure their spines, and there are sometimes secondary accidents caused by mistakes during transport or there are frequent situations to make the patient's condition worse.

Korean Utility Model Registration No. 20-0322778 discloses a technology including: a sheet body which has a non-slip member disposed on sides of upper and lower plate fabrics of many layers and a connection yarn of a predetermined length connecting the upper plate fabric and the lower plate fabric with each other, and has a tube shape formed by sealing of the upper and lower plate fabrics; an air inlet disposed at one side of the sheet body in order to inject and discharge air; and a pair of handle members disposed at both sides of the sheet body, spaced apart from each other at a predetermined interval in a back-and-forth direction, and adhered by adhering means. The adhering means for adhering the handle members to the sheet body applies an adhesive. The handle members and the sheet body which are adhered with each other by the adhesive are sewed together, and generally have waterproof-coating to form a surface coated layer.

However, the conventional technology is easy to keep and carry, is easy to use due to its light weight, and is to provide a stretcher, which does not need additional components except for the handle members. However, the conventional technology has several disadvantages in that a patient's body is twisted since a middle part of the sheet body droops down due to the patient's weight as soon as persons hold the handle members with the hands and raise up the stretcher in an emergency case, and in that patients with spinal-cord injuries may be in a life-threatening situation due to a secondary damage.

Furthermore, the conventional technology further includes a fastening belt for fastening the patient after a patient or an aged person lays on the stretcher. However, because an end portion of the fastening belt is connected from a width-direction end portion of the sheet body and is fastened to the sheet body loosely, the patient may be easily moved due to a space between the sheet body and the fastening belt and cannot secure safety during evacuation.

PATENT LITERATURE

Patent Documents

Patent Document 1: Korean Utility Model Registration No. 20-0322778 Y1 (Jul. 31, 2003)

SUMMARY OF THE INVENTION

Accordingly, the present invention has been made to solve the above-mentioned problems occurring in the prior arts, and it is an object of the present invention to provide an emergency medical mat for safe movement in case of disaster, which has an improved structure that a side reinforcement belt and a floor reinforcement belt are arranged to be overlapped and fixed by backstitch parts so that a bottom surface of the mat is supported by the floor reinforcement belt when persons hold handle parts and lift up the medical mat to carry the mat and the structure prevents deformation of a middle area of the mat to which a deflection load is applied by a patient's weight, thereby preventing a secondary accident of a patient with a serious case during a disaster evacuation.

To accomplish the above object, according to the present invention, there is provided an emergency medical mat for safe movement in case of disaster including: floor reinforcement belts which traverse the bottom surface of the medical mat in a width direction and are fixed and mounted by side backstitch parts; safe evacuation belts which are connected integrally to both end portions of the floor reinforcement belt and are fastened to each other by buckles so as to bind the patient, who lies down on the mat; and a side reinforcement belt which is mounted to surround the side of the mat, is fixed together with the floor reinforcement belts by the backstitch parts, and has handle parts formed at areas between the backstitch parts to be separated from the mat.

Moreover, a reinforcement member is mounted to traverse the bottom surface of the medical mat in a longitudinal direction, the side reinforcement belt is arranged to be overlapped with the floor reinforcement belts and to surround the floor reinforcement belts and is fixed by the backstitch parts, and when persons hold the handle parts and lift up the mat to carry the mat, the bottom surface of the mat is supported by the floor reinforcement belts connected to the side reinforcement belt.

Furthermore, the safe evacuation belts are disposed to be adjusted in length by length adjusters, each of the safe evacuation belts has an extension part extending from an end portion thereof and passing through a support roller mounted at the buckle, a pair of reinforcement sheets are disposed at side areas of the upper surface thereof, wherein an end of each reinforcement sheet is fixed at the position biased from the middle toward the edge in the width direction, and the other end is connected to the extension parts of the safe evacuation belts and is detachably mounted on the upper surface of the mat by a Velcro tape.

Additionally, the reinforcement sheets are formed in a band shape and are respectively connected to the extension parts, or are formed in a plate shape in such a way that a plurality of the extension parts are connected to an end portion of each plate-shaped reinforcement sheet.

In addition, when the safe evacuation belts which are opposed to each other are fastened by the buckle in order to fasten the patient and are tightened by the length adjusters, end portions of the reinforcement sheets are pulled by the extension parts, so that the reinforcement sheets bind together to surround sides of the patient, and position fixation power is at work above the patient by the safe evacuation belts and position fixation power is at work at both sides of the patient by the reinforcement sheets.

Moreover, the handle parts are disposed such that a lift load point is moved in the inward direction of the mat 1 by extension belts, an end of each extension belt is connected to the handle part and the other end is connected to the middle of the floor reinforcement belts after downwardly passing through the interior area of the upper surface of the mat, and when persons hold the extension belts and lift up the mat, lift load of the mat is dispersed to the handle parts and the middle part of the floor reinforcement belts so that the middle area of the mat to which a deflection load is applied by a patient's weight is supported.

Furthermore, vertical slits are formed in the upper surface of the mat corresponding to the extension belts and the extension belts are respectively inserted and sealed into the vertical slits, and the extension belts are separated from the vertical slits when being pulled, so that a triangular lifting line having a lift point to which lift load is applied, a side lift point connected to the handle parts, and a center lift point connected to the center of the floor reinforcement belt is formed.

According to the present invention, the emergency medical mat for safe movement in case of disaster includes an improved structure that a side reinforcement belt and a floor reinforcement belt are arranged to be overlapped and fixed by backstitch parts, so that a bottom surface of the mat is supported by the floor reinforcement belt when persons hold handle parts and lift up the medical mat to carry the mat and the structure prevents deformation of a middle area of the mat to which a deflection load is applied by a patient's weight, thereby preventing a secondary accident of a patient with a serious case during a disaster evacuation.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, exemplary embodiments of the present invention will be described with reference to the accompanying drawings. Further, in the following description of the present invention, a detailed description of known functions and configurations incorporated herein will be omitted when it may make the subject matter of the present invention rather unclear.

Figure 1A:
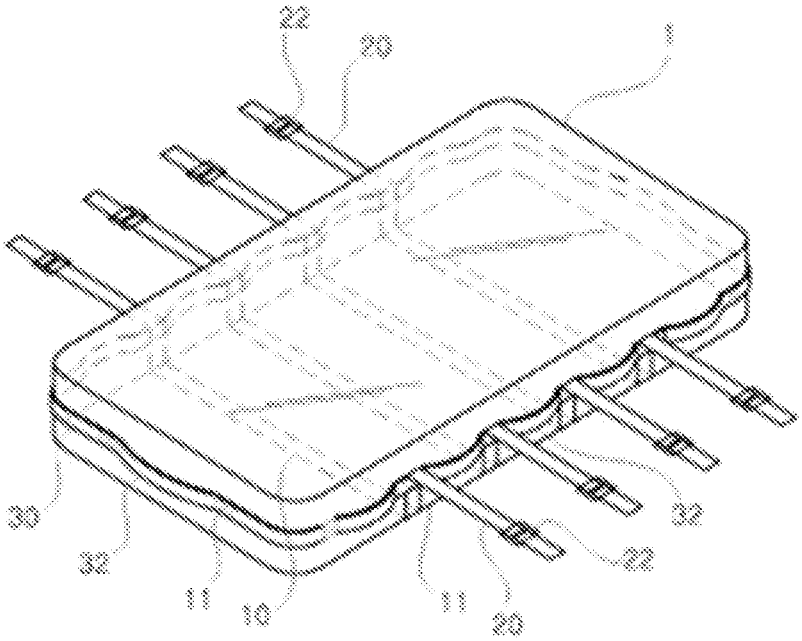
FIGS. 1A-1B are perspective views showing an emergency medical mat for safe movement in case of disaster according to an embodiment of the present invention.
Figure 1B:
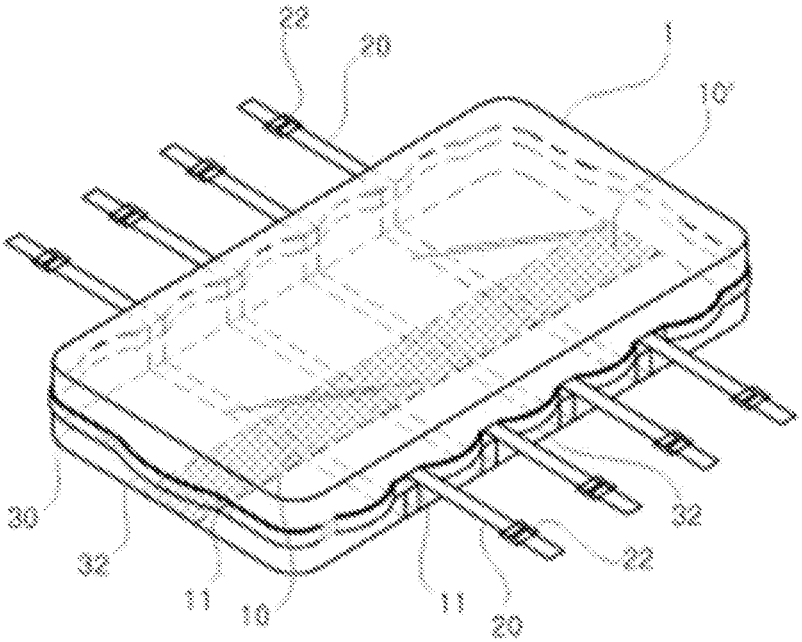
Figure 2:
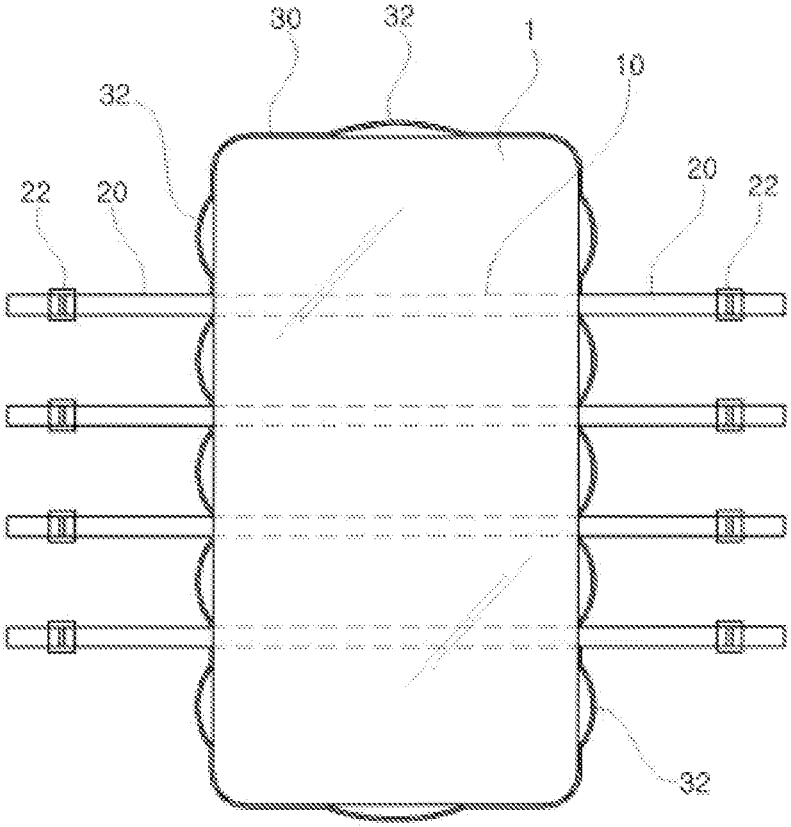
FIG. 2 is a plan view of the emergency medical mat for safe movement in case of disaster according to the embodiment of the present invention.
Figure 3:
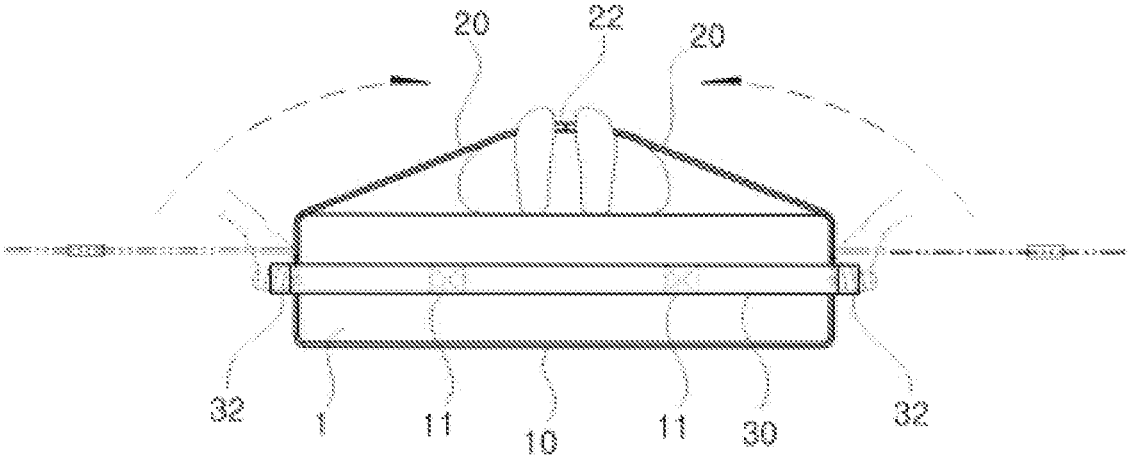
FIG. 3 is a view showing a used state of the emergency medical mat for safe movement in case of disaster according to the embodiment of the present invention.
Figure 4:
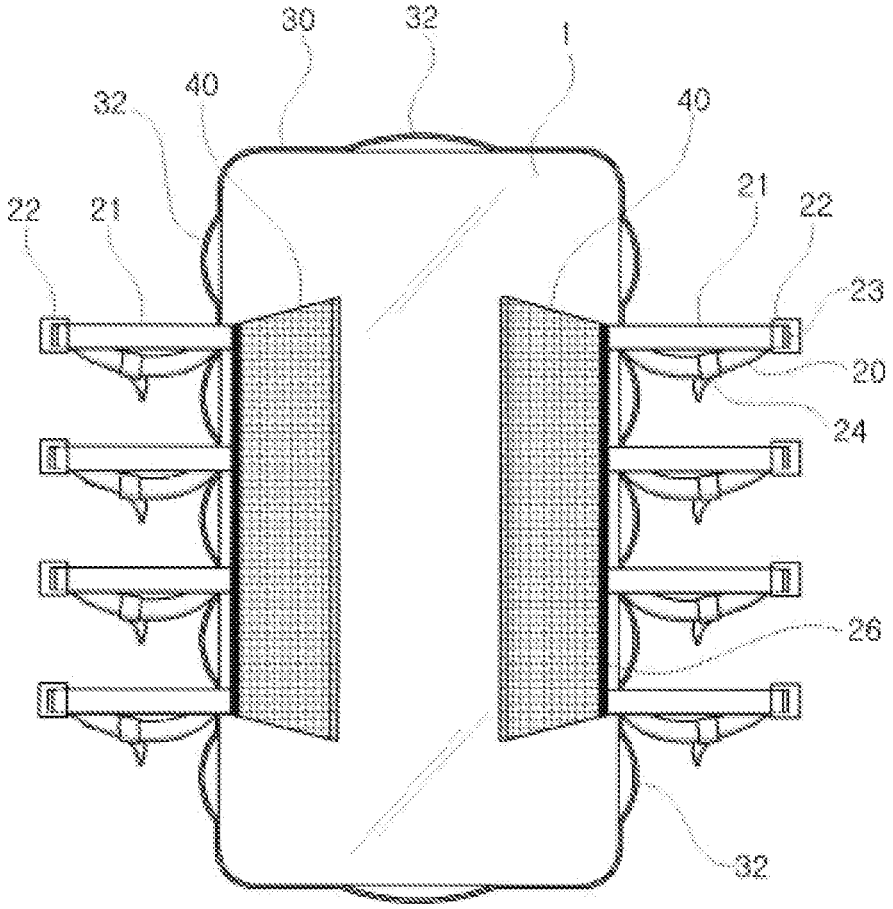
FIG. 4 is a view showing the emergency medical mat for safe movement in case of disaster according to the embodiment of the present invention.
Figure 5:
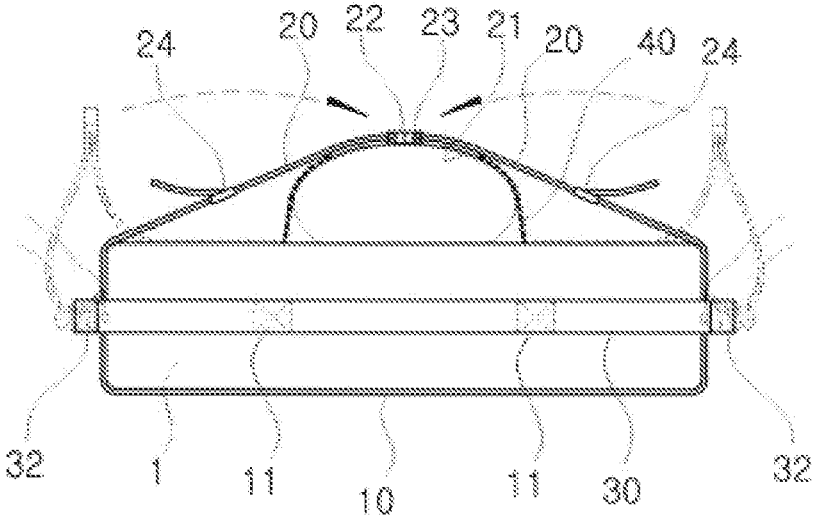
FIG. 5 is a view showing the used state of FIG. 4.
Figure 6:
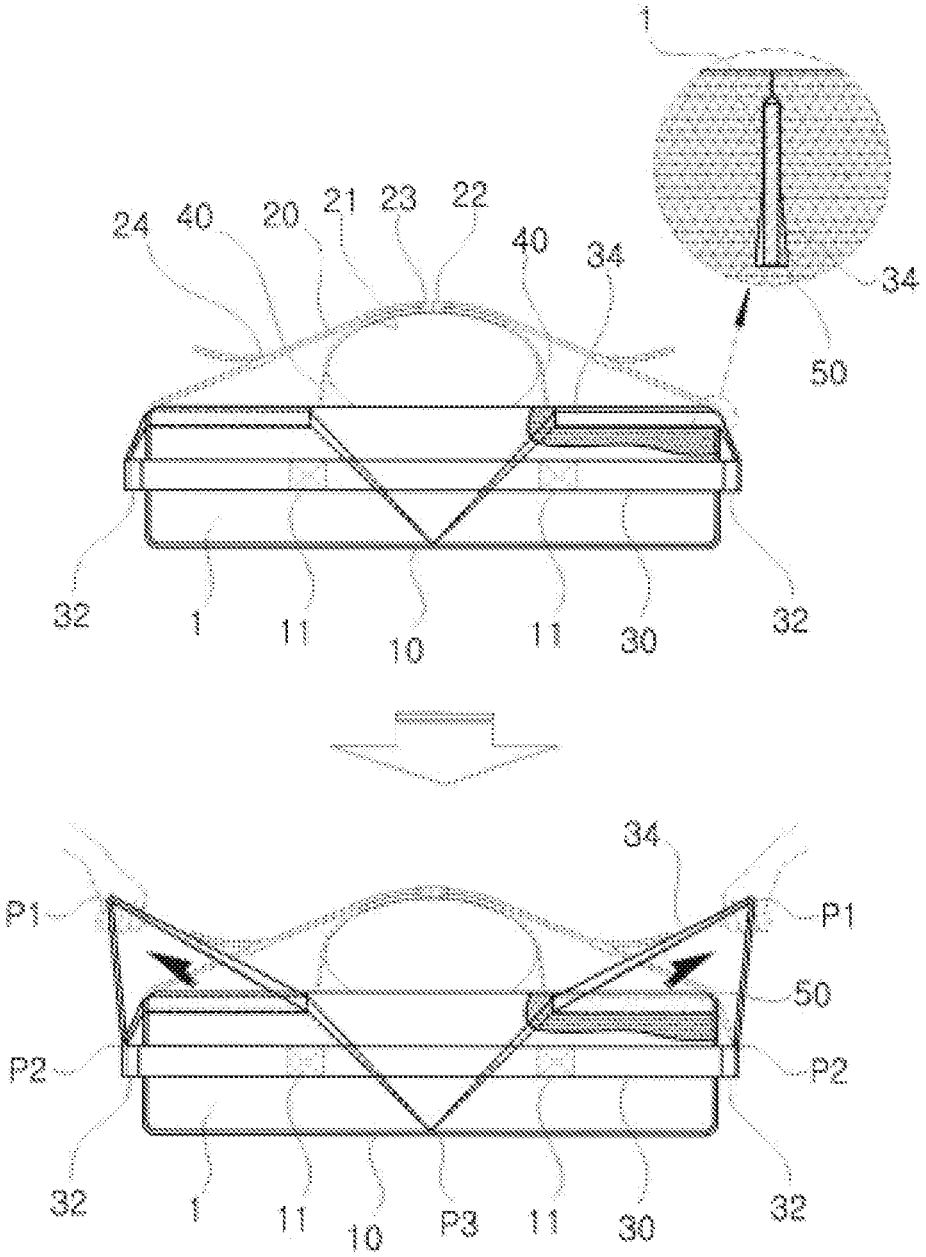
FIG. 6 is a view showing an extension belt of the emergency medical mat for safe movement in case of disaster according to the embodiment of the present invention.

FIGS. 1A-1B are perspective views showing an emergency medical mat for safe movement in case of disaster according to an embodiment of the present invention, FIG. 2 is a plan view of the emergency medical mat for safe movement in case of disaster according to the embodiment of the present invention, FIG. 3 is a view showing a used state of the emergency medical mat for safe movement in case of disaster according to the embodiment of the present invention, FIG. 4 is a view showing the emergency medical mat for safe movement in case of disaster according to the embodiment of the present invention, FIG. 5 is a view showing the used state of FIG. 4, and FIG. 6 is a view showing an extension belt of the emergency medical mat for safe movement in case of disaster according to the embodiment of the present invention.

The present invention relates to an emergency medical mat for safe movement in case of disaster, which has an improved structure that a side reinforcement belt and a floor reinforcement belt are arranged to be overlapped and fixed by backstitch parts so that a bottom surface of the mat is supported by the floor reinforcement belt when persons hold handle parts and lift up the medical mat to carry the mat and the structure prevents deformation of a middle area of the mat to which a deflection load is applied by a patient's weight, thereby preventing a secondary accident of a patient with a serious case during a disaster evacuation. The emergency medical mat for safe movement in case of disaster includes floor reinforcement belts 10, safe evacuation belts 20, and a side reinforcement belt 30.

The floor reinforcement belt 10 according to the present invention is fixed and mounted by side backstitch parts 11 after traversing the bottom surface of a medical mat 1 in a width direction.

The belt of a band type is arranged on the bottom surface of the mat 1 to be spaced apart along the bottom surface. FIGS. 1A-1B and 2 illustrate a state where four floor reinforcement belts 10 are arranged to be spaced apart from one another at four places. However, the present invention is not limited to the above, and the number and intervals of the floor reinforcement belts 10 may be adjusted according to the size of the mat 1 and a patient's height.

Additionally, as shown in FIG. 1B, a reinforcement member 10' is mounted to traverse the bottom surface of the medical mat 1 in a longitudinal direction. The reinforcement 10' includes a belt, is made of lightweight materials including carbon, aluminum, and synthetic resin, and is arranged in the middle of the medical mat 1.

When persons hold handle parts 32 formed at both end portions in the longitudinal direction and raise up the medical mat 1, the reinforcement member 10' prevents drooping of the medical mat 1 so that a patient can maintain a stable posture without being folded or bent in a U shape.

In addition, the safe evacuation belts 20 according to the present invention are connected integrally to opposite end portions of each floor reinforcement belt 10, and are fastened to each other by buckles 22 so as to bind a patient, lying lies down on the mat 1.

The safe evacuation belts 20 are formed in a band shape, and are connected integrally to each floor reinforcement belt 10. That is, the safe evacuation belts 20 and the floor reinforcement belt 10 are respectively formed in a single band belt.

Moreover, the buckles 22 are locked and unlocked in a way of one touch, and is configured to rapidly fasten a patient in an emergency and rapidly release the fastened state after evacuation to a safe place.

In FIG. 3, the side reinforcement belt according to the present invention is mounted to surround the perimeter of the mat 1 and is fixed together with the floor reinforcement belts 10 by the backstitch parts 11. Areas between the backstitch parts 11 are separated from the mat 1 to form handle parts 32.

In this instance, the side reinforcement belt 30 is arranged to be overlapped with the floor reinforcement belts 10 and to surround the floor reinforcement belts 10 and is fixed by the backstitch parts 11. When the persons hold the handle parts 32 and lift up the mat 1 to carry the mat 1, the bottom surface of the mat 1 is supported by the floor reinforcement belts 10 connected to the side reinforcement belt 30.

So, the medical mat 1 according to the present invention can prevent a secondary accident of a patient with a serious case since preventing deformation of the middle area of the mat 1 to which a deflection load is applied by a patient's weight at the time of disaster evacuation.

In FIG. 4, the safe evacuation belts 20 are disposed to be adjusted in length by length adjusters 24. Each of the safe evacuation belts 20 has an extension part 21 extending from an end portion thereof and passing through a support roller 23 mounted at the buckle 22. The mat 1 includes a pair of reinforcement sheets 40 disposed at side areas of the upper surface thereof. An end of each reinforcement sheet is fixed at the position biased from the middle toward the edge in the width direction, and the other end is connected to the extension parts 21 of the safe evacuation belts 20 and is detachably mounted on the upper surface of the mat 1 by a Velcro tape 26.

In this instance, the reinforcement sheets 40 are formed in a band shape and are respectively connected to the extension parts 21, or are formed in a plate shape in such a way that a plurality of the extension parts 21 are connected to an end portion of each plate-shaped reinforcement sheet 40 as shown in FIG. 4. Furthermore, if the reinforcement sheets 40 are formed in the plate shape, they are made with mesh fabric or flexible fabric to surround sides of the patient flexibly.

In FIG. 5, when the safe evacuation belts 20 which are opposed to each other are fastened by the buckles 22 in order to fasten the patient and are tightened by the length adjusters 24, end portions of the reinforcement sheets 40 are pulled by the extension parts 21, so that the reinforcement sheets 40 bind together to surround sides of the patient.

Therefore, the medical mat 1 according to the present invention has a double position fixing structure that position fixation power is at work at both sides of the patient by the reinforcement sheets 40, thereby securing the patient's safety during disaster evacuation.

In FIG. 6, the handle parts 32 are disposed such that a lift load point is moved in the inward direction of the mat 1 by extension belts 34. An end of each extension belt 34 is connected to the handle part 32 and the other end is connected to a middle of each floor reinforcement belt 10 after downwardly passing through an interior area of the upper surface of the mat 1.

Additionally, when persons hold the extension belts 34 and lift up the mat 1, a lift load of the mat 1 is dispersed to the handle parts 32 and the middle of each floor reinforcement belt 10 so that the middle of the mat 1 to which a deflection load is applied by a patient's weight is supported.

In addition, vertical slits are formed in the upper surface of the mat 1 corresponding to the extension belts 34, and the extension belts 34 are respectively inserted and sealed into the vertical slits 50.

Therefore, the extension belts 34 are separated from the vertical slits 50 when being pulled, and a triangular lifting line having a lift point P1 to which a lift load is applied, a side lift point P2 connected to the handle parts 32, and a center lift point P3 connected to the middle of each floor reinforcement belt 10 is formed. Therefore, the medical mat according to the present invention can prevent deformation and drooping of the middle area of the mat 1 to which a deflection load is applied by a patient's weight.

As described above, while the present invention has been particularly shown and described with reference to the example embodiment thereof, it will be understood by those of ordinary skill in the art that various changes, modifications and equivalents may be made in the present invention without departing from the technical scope and idea of the present invention. Therefore, it would be understood that the protective scope of the present invention is not limited by the example embodiment but covers the appended claims and their equivalents.

What is claimed is:

1. An emergency medical mat for safe movement in case of disaster comprising:

floor reinforcement belts which traverse a bottom surface of the medical mat in a width direction and are fixed and mounted by side backstitch parts;

safe evacuation belts which are connected integrally to opposite end portions of each floor reinforcement belt and are fastened to each other by buckles so as to bind a patient lying down on the mat; and a side reinforcement belt which is mounted to surround a perimeter of the mat, is fixed together with the floor reinforcement belts by the backstitch parts, and has handle parts formed at areas between the backstitch parts that are separated from the mat.

2. The emergency medical mat according to claim 1, wherein a reinforcement member is mounted to traverse the bottom surface of the medical mat in a longitudinal direction, the side reinforcement belt is arranged to be overlapped with the floor reinforcement belts and to surround the floor reinforcement belts and is fixed by the backstitch parts, and when persons hold the handle parts and lift up the mat to carry the mat, the bottom surface of the mat is supported by the floor reinforcement belts connected to the side reinforcement belt.

3. The emergency medical mat according to claim 1, wherein the safe evacuation belts are disposed to be adjusted in length by length adjusters, each of the safe evacuation belts has an extension part extending from an end portion thereof and passing through a support roller mounted at the buckle, a pair of reinforcement sheets are disposed at side areas of an upper surface of the mat, wherein an end of each reinforcement sheet is fixed at the position biased from a middle toward an edge of the mat in the width direction, and another end is connected to the extension parts of the safe evacuation belts and is detachably mounted on the upper surface of the mat by a hook and loop fastener.

4. The emergency medical mat according to claim 3, wherein the reinforcement sheets are formed in a band shape and are respectively connected to the extension parts, or are formed in a plate shape in such a way that a plurality of the extension parts are connected to an end portion of each plate-shaped reinforcement sheet.

5. The emergency medical mat according to claim 3, wherein when the safe evacuation belts which are opposed to each other are fastened by the buckles in order to fasten the patient and are tightened by the length adjusters, end portions of the reinforcement sheets are pulled by the extension parts, so that the reinforcement sheets bind together to surround sides of the patient, and position fixation power is configured to be at work above the patient by the safe evacuation belts and position fixation power is configured to be at work at both sides of the patient by the reinforcement sheets.

6. The emergency medical mat according to claim 3, wherein the handle parts are disposed such that a lift load point is moved in the inward direction of the mat by extension belts, an end of each extension belt is connected to each handle part and another end is connected to a middle of each floor reinforcement belt after downwardly passing through an interior area of the upper surface of the mat, and when persons hold the extension belts and lift up the mat, a lift load of the mat is dispersed to the handle parts and the middle of each floor reinforcement belt so that the middle of the mat to which a deflection load is applied by a patient's weight is supported.

7. The emergency medical mat according to claim 3, wherein vertical slits are formed in the upper surface of the mat corresponding to the extension belts and the extension belts are respectively inserted and sealed into the vertical slits, and the extension belts are separated from the vertical slits when being pulled, so that a triangular lifting line having a lift point to which a lift load is applied, a side lift point connected to the handle parts, and a center lift point connected to the middle of each floor reinforcement belt is formed.

* * * * *